United States Patent [19]

Santucci

[11] 4,411,293

[45] Oct. 25, 1983

[54] DEVICE FOR KEEPING CONSTANT BOTH THE SPEED AND THE TENSION WHEN REELING OFF THE WARP THREAD FROM THE WARP BEAM IN A LOOM

[75] Inventor: Nicola Santucci, Schio, Italy

[73] Assignee: Nuovo Pignone S.p.A., Florence, Italy

[21] Appl. No.: 315,045

[22] Filed: Oct. 26, 1981

Related U.S. Application Data

[63] Continuation of Ser. No. 882,239, Feb. 28, 1978, which is a continuation of Ser. No. 744,108, Nov. 22, 1976, abandoned.

[30] Foreign Application Priority Data

Dec. 11, 1975 [IT] Italy ..... 30193 A/75

[51] Int. Cl.[3] ..... D03D 49/06

[52] U.S. Cl. ..... 139/110

[58] Field of Search ..... 139/99, 110

[56] References Cited

U.S. PATENT DOCUMENTS 3,308,854 3/1967 Pfarrwaller ..... 139/99

3,630,239 12/1971 Hooper ..... 139/110

FOREIGN PATENT DOCUMENTS 456060 2/1975 U.S.S.R. ..... 139/110

*Primary Examiner*—Henry Jaudon

*Attorney, Agent, or Firm*—Hedman, Casella, Gibson, Costigan & Hoare

[57] ABSTRACT

In a textile loom, the invention comprises a device for varying the speed and the tension of unreeling the warp threads from the warp beam. The device essentially includes a set of interchangeable spur gears connected to the warp beam which cooperate with a system of variable-race sheaves so that when a sheave has its race becoming narrower, the other sheave has its race widened and vice versa. Proper linkages are also provided to ensure that there is always a constant balance between the tension of the warp threads and the speed of rotation of the warp beam. Consequently, as the diameter of warp threads on the beam is decreased and the speed of the warp threads is concurrently decreased, the device imparts a pull increase to the warp threads so that the unreeling speed of the threads from the warp beam is automatically brought back to a preselected constant value.

1 Claim, 2 Drawing Figures

Figure 1:
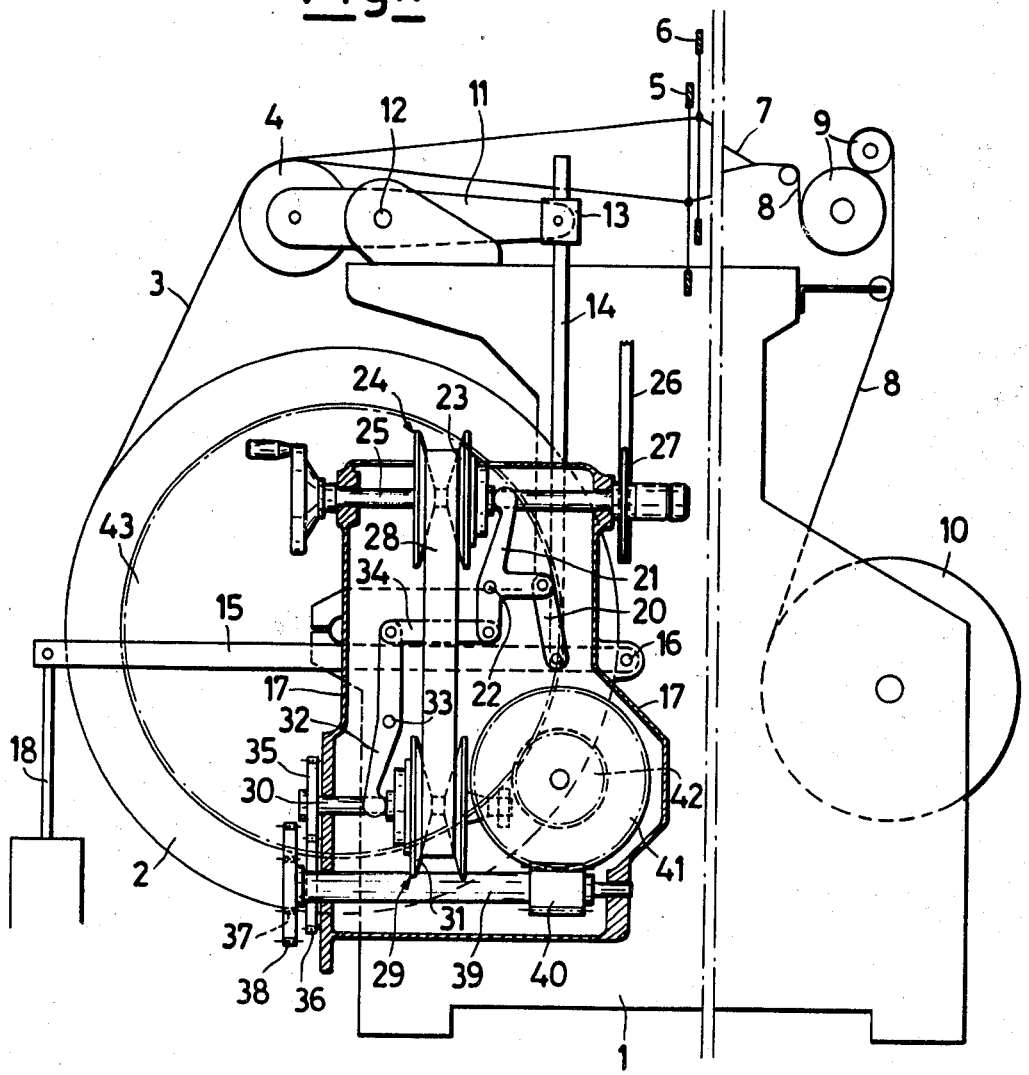

DEVICE FOR KEEPING CONSTANT BOTH THE SPEED AND THE TENSION WHEN REELING OFF THE WARP THREAD FROM THE WARP BEAM IN A LOOM

This is a continuation of application Ser. No. 882,239, filed Feb. 28, 1978 which is a continuation of Ser. No. 744,108 filed Nov. 22, 1976 (now abandoned).

This invention relates to an improved device which is adapted to keep constant both the speed and the tension when reeling off the warp thread from the warp beam in a loom, even when the such a speed must be extremely low.

As is known, a fabric is formed in a loom by intertwining weft and warp threads. The warp threads are located in the loom in a storage device called the warp beam from which the warp threads are withdrawn at a constant speed and under a constant tension during weaving since the number of picks per minute of the weft thread is constant. Now, since the diameter of the warp thread mass, as the thread is gradually unreeled, is gradually reduced until reaching the diameter of the metallic core on which the warp thread is wound, it is apparent that the angular speed of the warp beam must be proportionally increased in order to maintain the unreeling speed constant. Stated another way, the warp beam must be controlled by a device which is capable of varying the rotation speed as a function of the gradual exhaustion of the warp thread reserve. On the other hand, a loom must be capable of fulfilling all the conventional weaving requirements, such as weaving fabrics with different numbers of picks per inch. Inasmuch as the formation of a fabric formed by a considerable number of picks per inch requires a very slow rotation of the warp beam, whereas for a fabric having a restricted number of picks per inch the rotation of the warp beam must be comparatively fast, a control device must be capable of setting up a number of rotational speeds for the warp beam.

The prior art has disclosed a number of devices for setting up different speeds of rotation for the warp beam and for appropriately varying said set up speeds as the diameter of the warp thread mass on the beam varies in order to keep constant both the speed and the tension of the warp thread as it unreels.

According to one of these prior art embodiments, the warp beam is controlled through a gear arrangement coupled to the drive shaft of a second sheave. The rotation of the shaft of the second sheave having a variable race is effectuated by a V-belt connected to a first sheave also having a variable race, the shaft of which is driven by the drive shaft of the loom via a set of gears which are interchangeable and arranged so as to provide different gear ratios and thus set up different speeds for the warp beam. The races of the sheaves are varied with consequent shifts of the V-belt and thus variations in the gear ratio resulting in variations in the rotational speed of the warp thread through a system of levers and rods which are responsive to the tension of the warp thread.

An approach of this kind, however, has the serious defect that it poorly adjusts, or does not adjust at all, when the speed is low. As a matter of fact, an adjustment system composed of variable-race sheaves such as the one referred to above must be in motion to provide gear ratio variations. Shifts of the V-belt must take place during shorter intervals as the rotational speed of the system increases. Now, on account of the fact that the rotation motion is transferred to the sheaves by the driving shaft of the loom through the set of interchangeable gears which set up the different speeds of the warp beam, whenever fabrics are to be woven which have a considerable number of picks per inch, i.e. when the warp loom is to be rotated very slowly, the sheaves are forced to rotate very slowly. This causes a situation wherein the sensitivity and the response time of an adjustment system are substantially reduced or nearly nonexistent.

An object of the present invention is thus to overcome the drawbacks of the prior art and to provide a device which is capable of setting up a number of different rotational speeds of the warp beam and of properly adjusting such speeds when the diameter of the thread mass of the warp beam varies in order to keep constant both the speed and the tension of the warp thread as it unreels. Also, a further object is to provide a variable-race-sheave system which is nonetheless reliable and safe even at very low rotational speeds of the warp beam.

According to one feature of the present invention, the device includes a system of cylindrical gears which are mutually meshing and interchangeable so as to provide a number of different gear ratios. The system is connected to the warp beam and is driven by the second one of a pair of variable-race sheaves which are mutually connected by a V-belt. The first variable-race-sheave is driven by the drive shaft of the loom with the variation of the races of the variable-race sheaves being governed by a linkage which is responsive to the tension of the warp thread.

As a result of the above arrangement, the variable-race sheaves are always operated at the constant high speed of the loom, that is, at a speed which is no longer dependent of the gear ratios of the gears of the gear system. An efficient adjustment means is thereby provided for the rotational speed of the warp beam as a function of the decrease of the diameter of the warp thread mass on the beam even when the speed is extremely low.

Other features of the invention will become apparent hereinafter, wherein the invention will be better explained with reference to the accompanying drawings which are illustrative of a preferred embodiment of the invention given by way of example only and without limitation, inasmuch as technical and constructional changes can be introduced therein without departing from the scope of the instant invention.

Figure 2:
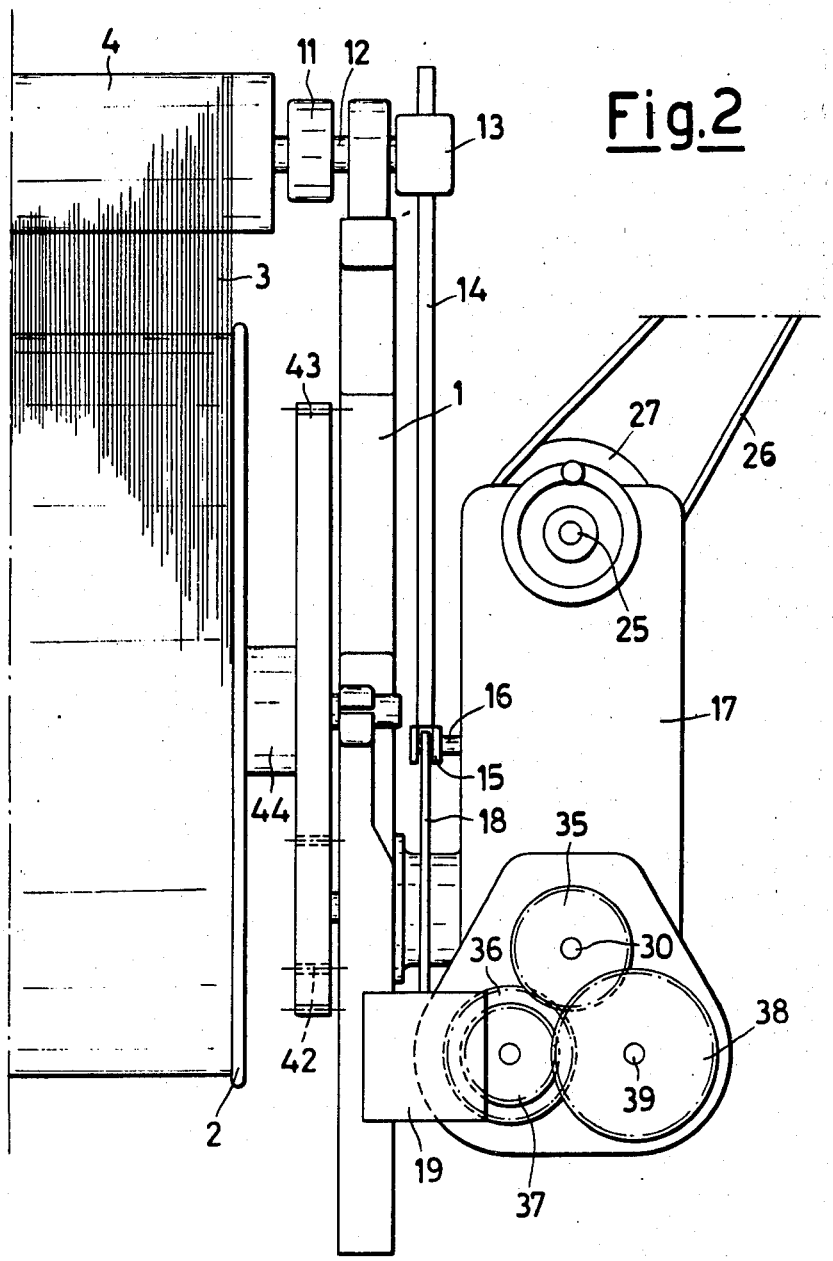

In the drawings:

FIG. 1 is a diagrammatical front view, partly in section, of a loom which incorporates the device according to the present invention, and FIG. 2 is a diagrammatical view, but in lengthwise elevation and on a different scale, from that which is shown in FIG. 1.

With reference to the drawings, the numeral 1 indicates the fixed frame of the loom, and the numeral 2 is the metallic core of the warp beam which is rotatably supported by the loom and on which the warp threads 3 are wound. The warp threads 3 as taken from the warp beam are passed onto a drum 4 and then the healds 5 and 6 make up a shed 7. In the interior of the shed 7 a weft thread is picked to form a fabric 8 which is entrained by the entraining rolls 9 and then wound on a cloth beam 10.

The drum 4 is supported for rotation at the end of a rocker 11, which is pivotally mounted at 12 on a fixed frame 1. The opposite end of the rocker 11 is pivotally mounted at the block 13. One end of a clevis 14 supports the block 13 while the other end is fulcrumed at 16 to a fixed frame 17. The rod 15 is pinned at one end to point 16 while the distal end of 15 supports a rod 18 carrying a weight 19. The weight 19 is a counterweight to balance the rocker 11 relative to the downward force, caused by the tension of the warp threads 3 on the drum 4.

The lever 15 is then connected, by the connecting rod 20, to a bell-crank lever 21. The latter, fulcrumed at 22 to the fixed frame 17, acts upon the movable member 23 of a variable-race sheave 24 which is mounted on the shaft 25. The shaft 25 is supported for rotation by the frame 17 and rotatably driven by the mainshaft of the loom via the belt 26 and the sheave 27 keyed to the mainshaft. The variable-race sheave 24 is connected by a V-belt 28 to a second variable-race sheave 29 mounted on a shaft 30 supported for rotation by the fixed framing 17. The movable member 31 of the second variable-race sheave 29 is driven by a second bell-crank lever 32, which is fulcrumed, at 33, to the fixed frame 17 and is connected by a connecting rod 34, to said first bell-crank lever 21. The connection is such that an anti-clockwise rotation of the first bell-crank lever, which involves a shrinking of the race of the first variable-race sheave 24, corresponds to a rotation in the clockwise direction of the second bell-crank lever 32, the result being a widening of the race of the second variable-race sheave 29, and vice versa, so that the V-belt 28 can be displaced along the races of the two sheaves 24 and 29 to vary the gear ratio.

On the shaft 30 of the second variable-race sheave 29, a removable spur gear 35 is now mounted integrally for rotation. The spur gear 35 is in mesh with a spur gear 36 which is supported for the rotation on the frame, but is removable therefrom. Integral and coaxial with the gear 36, but still removable, there is a spur gear 37 meshing with a spur gear 38, the latter removably being mounted on a shaft 39 which is supported for rotation by the frame 17. A worm 40 is mounted on the shaft 39 meshing with a worm wheel 41 which is supported for rotation by the frame 17 and is integral and coaxial with a gear 42. The f gear 42 meshes with a gear 43 fastened to the axle 44 of the warp beam 2.

The gear set 35, 36, 37 and 38 is intended to set up the desired speed for the warp beam as a function of the kind of fabric to be woven. These gears are mounted removably on their axles so as to make the gears conveniently interchangeable, so as to obtain a number of gear ratios and thus a number of different warp beam speeds.

The operation of the device is self-explanatory.

Once the desired speed of rotation of the warp beam has been set up by appropriately connecting the four gears 35, 36, 37 and 38, the loom is started. As the diameter of the warp thread mass on the beam is decreased, the speed at which the warp threads 3 are reeled off the warp beam tends to be decreased and, since the entraining rollers 9 still draw with the same speed as set up initially, a tension increase is generated in the warp threads. The tension increase acting upon the drum 4, causes a counterclockwise rotation of the rocker 11. As a result, the lever 15 is lifted and thus the bell-crank lever 21 is rotated counterclockwise and narrows the race of the sheave 24, whereas the bell-crank lever 32 is rotated clockwise and widens the race of the sheave 29. Inasmuch as the sheaves are rotating rapidly, the V-belt 28 is swiftly shifted upwards which causes an increase of its surface speed and consequently an increase of the angular speed of the sheave 29. The end result is an increase of the angular speed of the warp beam and thus of the speed of unreeling of the warp threads, which is thus brought back to the desired value.

What I claim is:

1. A device for keeping constant the speed and the unreeling tension of the warp threads from the warp beam of a loom having a main shaft even when the speed is extremely low comprising:

a first variable-race input sheave mounted on a first rotatable shaft coupled to the loom main shaft and driven thereby, a second variable-race output sheave mounted on a second rotatable shaft supported by said loom and having one end extending outwardly therefrom, a V-belt connecting the first and second variable-race sheaves, a third shaft rotatable mounted on said loom below said second shaft and having one end extending outwardly therefrom having a worm gear located thereon, interchangeable and readily accessible gear means mounted on the outwardly extending ends of the second and third shafts and connecting the second shaft to the third shaft on the exterior of said loom, said gear means comprising a worm wheel coupled to the warp beam, a set of meshing spur gears, one of said spur gears being mounted on the second shaft with the second variable race sheave and being driven thereby and another spur gear in said set being mounted on a third shaft and having a worm thereon transmitting said drive to the worm wheel to drive said warp beam, and including coupling means engaging the worm gear and the warp beam to drive said warp beam for unreeling of the warp thread at a predetermined constant speed for the particular fabric being woven, a third of said spur gears comprising a pair of integtral, coaxially mounted spur gears drivingly interconnecting said one and said another spur gears and linkage means directly connected to the two variable-race sheaves and in engagement with the warp threads, said linkage means simultaneously varying the races of the first and second sheaves to maintain the unreeling speed and tension of the warp threads by varying the speed of the warp beam at the output of the second variable sheave, said linkage means comprising a drum onto which the warp threads being unreeled from the warp beam are passed, a rocker supporting the drum at one end, a first bell crank level connected to the second output sheave to vary the races of said sheaves in opposite directions, a counterweight, and connecting means coupled to the other end of the rocker and to the counterweight to permit movement in response to the motion of the drum and wherein the bell-crank levers are connected to said means to vary the races of the sheaves in response to the tension of the warp threads.

* * * * *